US005515653A

United States Patent [19]

Smart

[11] Patent Number: 5,515,653

[45] Date of Patent: May 14, 1996

[54] ROOF STARTER CORNER

[76] Inventor: Wayne G. Smart, R.R. 1, Box 45, West Chazy, N.Y. 12292

[21] Appl. No.: 12,598

[22] Filed: Feb. 3, 1993

Related U.S. Application Data

[63] Continuation-in-part of Ser. No. 743,692, Aug. 12, 1991.

[51] Int. Cl.[6] ..... E04D 13/15

[52] U.S. Cl. ..... 52/60; 52/94; 52/96

[58] Field of Search ..... 52/94, 95, 96, 52/58, 60, 61, 62

[56] References Cited

U.S. PATENT DOCUMENTS

| | | | |
|---|---|---|---|
| 1,419,287 | 6/1922 | Maxwell | 52/60 |
| 1,699,181 | 1/1929 | Davison | 52/60 |
| 3,415,020 | 12/1968 | Windle | 52/96 |
| 3,501,873 | 3/1970 | Berg | 52/60 |
| 3,668,811 | 6/1972 | Pollard | 52/94 |
| 4,848,045 | 7/1989 | Nichols et al. | 52/60 |

FOREIGN PATENT DOCUMENTS

| | | | |
|---|---|---|---|
| 2084628 | 4/1982 | United Kingdom | 52/96 |

*Primary Examiner*—Michael Safavi
*Attorney, Agent, or Firm*—Beth Kovitz Fields

[57] ABSTRACT

A starter corner for use in constructing a shingled roof is provided. The starter corner is adapted to be positioned in the corner of a roof during construction for the purpose of preventing ice formation and backup damage to the finished roof.

12 Claims, 4 Drawing Sheets

ROOF STARTER CORNER

This application is a continuation-in-part of copending U.S. patent application Ser. No. 07/743,692, filed Aug. 12, 1991.

FIELD OF THE INVENTION

This invention relates generally to drip-edging used in the roofing trade and, in particular, to drip-edging in the shape of a starter corner for use in laying shingled roofs.

BACKGROUND OF THE INVENTION

Shingled roofs are constructed in multiple layers of roofing material. A wooden deck for the roof is formed of plywood or other suitable material. Asphalt saturated felt is laid over the deck to provide an underlayment. Drip-edging is laid over the underlayment along the eaves of the roof in climates where average winter temperatures can be 25° F. or less or where there is a possibility of ice formation along the eaves.

The drip-edging prevents water and ice backup damage to the underlayment of the roof. In general, the drip-edging is formed of a piece of sheet metal such as aluminum, galvanized iron, copper or the like and has a hem edge or flange of between about ¼ and ⅜ inches. The drip-edging is positioned on the underlayment so that the hem edge extends towards the ground along the fascia of the roof. Shingles are laid over the underlayment and extend over the metal drip-edging.

Commonly used drip-edging is straight, without corners or bends. It is necessary to cut or snip two pieces of edging and fashion a custom fit each time a corner of the roof is reached. This requires time, dexterity and skill at a height of ten or more feet above the ground. It has been known to happen that drip-edging will be omitted at the corners in situations where a workman is too lazy or too pressed for time to fashion the necessary custom fit.

It is, therefore, desirable to provide a starter corner for roofing that obviates the difficulties associated with custom fitting of drip-edging around a corner.

SUMMARY OF THE INVENTION

Generally speaking, a roof starter corner is provided. The starter corner includes a substantially flat, unseamed L-shaped piece of edging material having a first leg and a second leg that form an angle therebetween. The first and second legs define an outer edge that is adapted to be positioned over the ground external to the eaves of the roof and an underside that is adapted to be positioned adjacent an underlayment of the roof. A hem edge of edging material is formed parallel to the outer edge and adjacent to and at an angle with respect to the underside. Accordingly, the starter corner can be positioned at a corner of a roof underlayment so that the underside of the flat piece is positioned adjacent the roof underlayment and the hem edge fits against the fascia of the roof and extends towards the ground to prevent ice formation and backup damage to the finished roof.

Accordingly, it is an object of the invention to provide drip-edging in the form of a roof starter corner.

Another object of the invention is to provide a roof starter corner that obviates the need to fashion a custom fitted corner from straight pieces of drip-edging.

A further object of the invention is to provide a roof starter corner that can be positioned on a roof underlayment with minimal manual dexterity.

Still another object of the invention is to provide a roof starter corner that permits time to be saved in laying a roof.

Still a further object of the invention is to prevent the omission of drip-edging at roof corners.

Still other objects and advantages of the invention will in part be obvious and will in part be apparent from the specification.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
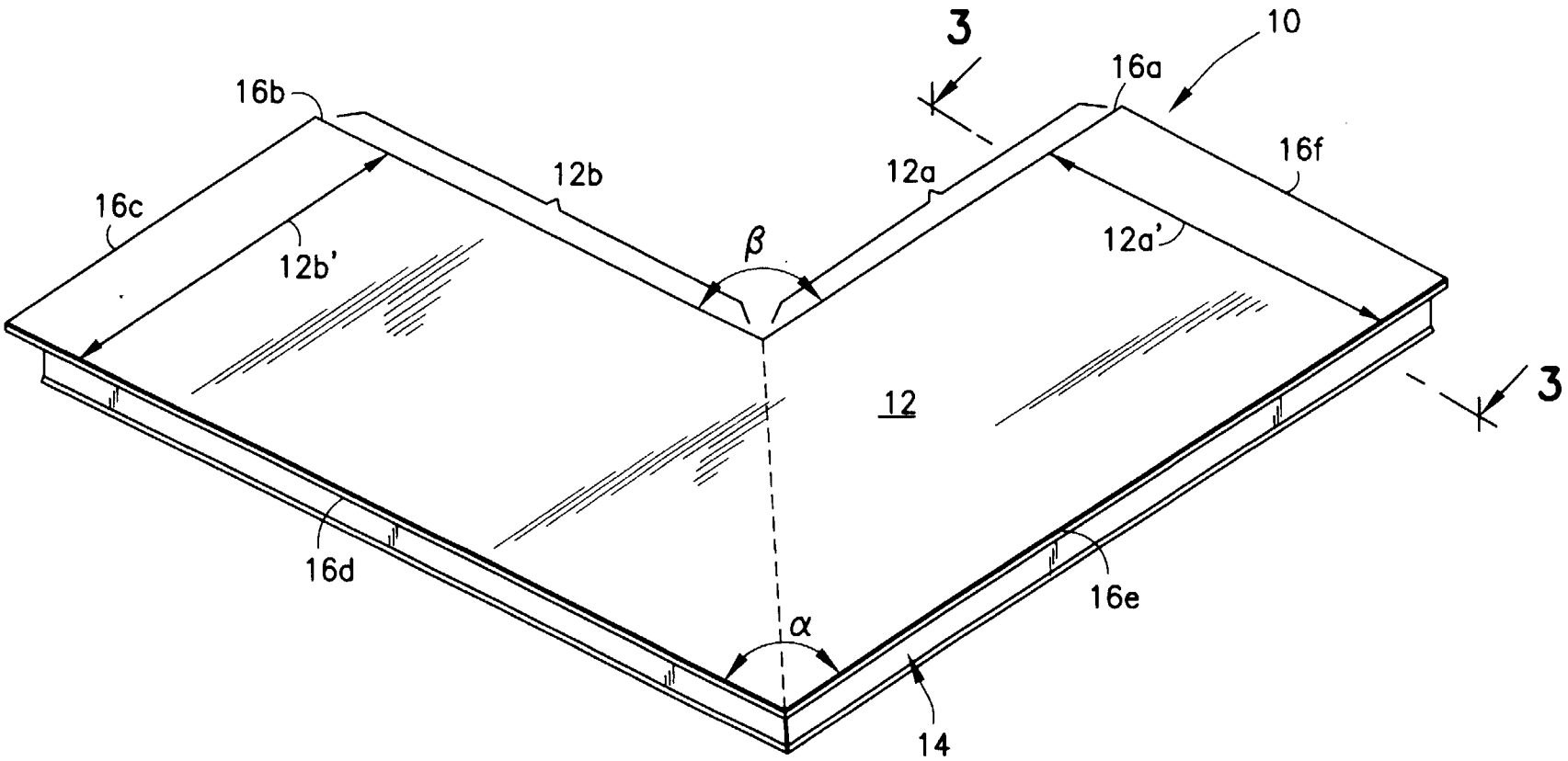
FIG. 1 is a perspective view of a starter corner constructed and arranged in accordance with the invention.
Figure 2:
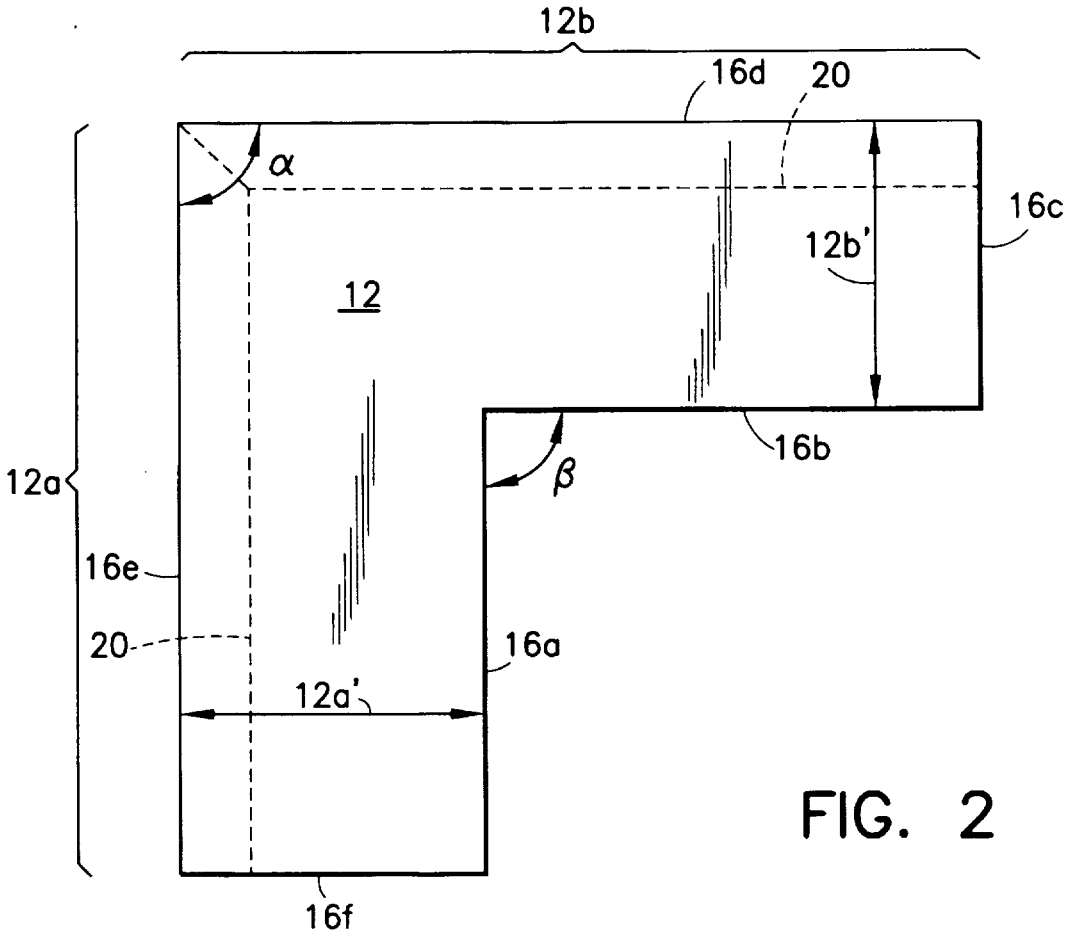
FIG. 2 is a top plan view of the starter corner of FIG. 1.
Figure 3:
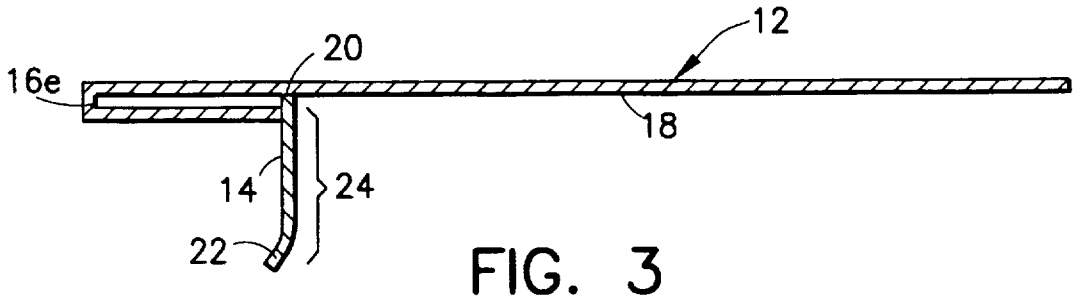
FIG. 3 is a cross-sectional view through section line 3—3 of FIG. 1.

Reference is made to FIG. 1 wherein a roof starter corner, generally indicated as 10, constructed in accordance with the invention is depicted. The starter corner 10 includes a flat substantially L-shaped piece of edging material 12 and a hem edge 14.

For purposes of clarity of description, the substantially L-shaped piece of edging material 12 is formed with a first leg **12*a* and a second leg 12*b*** that join to form an inside angle alpha and a subtended angle beta. In general, angle alpha is equal to angle beta and both angle alpha and angle beta are right angles, i.e. both are equal to 90 degrees.

In addition, each of the legs **12*a* and 12*b* have a substantially constant width 12*a*' and 12*b*', respectively. In general, width 12*a*' is equal to width 12*b*', although it is understood that this is not necessary in order to effect the essence of the invention. The widths 12*a*' and 12*b*' are selected so as to be effective for preventing ice formation and backup damage to the underlayment of the roof in cold and wet climates. Generally, the widths 12*a*' and 12*b*'** range between about two (2) and four (4) inches, preferably between about 2½ and 3½ inches, and more preferably between about three (3) and 3¼ inches.

The L-shaped piece of edging material 12 is a unitary construction formed from a single piece of edging material and is, therefore, necessarily unseamed. In particular, it is understood that there is no seam at a junction where the legs **12*a* and 12*b*** meet.

The L-shaped piece of edging material has six edges **16*a–f*. For descriptive purposes, edges 16*a* and 16*b* form an inside edge, edges 16*c* and 16*f* form joining edges where the starter corner will be joined to conventional straight pieces of drip edging, and edges 16***d* and 16*e* form an outer edge. The inside edges 16*a* and 16*b* and major portions of joining edges 16*c* and 16*f* will directly overlap the roof underlayment when the starter corner 10 is used, while the outer edges 16*d* and 16*e* and minor portions of joining edges 16*c* and 16*f* will overhang the line of the roof and therefor, will not overlap the underlayment.

The hem edge 14 is secured to one side of the L-shaped piece of edging material 12. The side of the edging material 12 to which the hem edge 14 is secured will be referred to as the underside 18.

The hem edge 14 extends substantially perpendicularly with respect to the underside 18 of the edging material 12 along a line 20 substantially parallel to each of the outer edges 16*d* and 16*e*. In a preferred embodiment, the line 20 is about ⅙th of the distance between the outer edges 16*d* and 16*e* and the inner edges 16*a* and 16*b*. Specifically, the line 20 is between about ¼ and ¾ inches from the outer edges 16*d* and 16*e*, preferably between about ⅜ and ⅝ inches, and more preferably about ½ inch.

The hem edge 14 has a length 24 of between about ½ and 1½ inches, preferably between about ¾ and 1¼ inches, and more preferably about one (1) inch. A flange 22 can be formed along the hem edge 14 distal the underside 18 and extends in the direction of the outer edges 16*d* and 16*e* of the edging material 12 so as to deflect water away from a building on which the starter corner 10 is used.

The starter corner 10 is preferably constructed of a suitable material for preventing ice formation and backup damage to the underlayment of a roof, preferably a metal material. Suitable materials include, but are not limited to, aluminum, galvanized iron, copper and the like.

Figure 4:
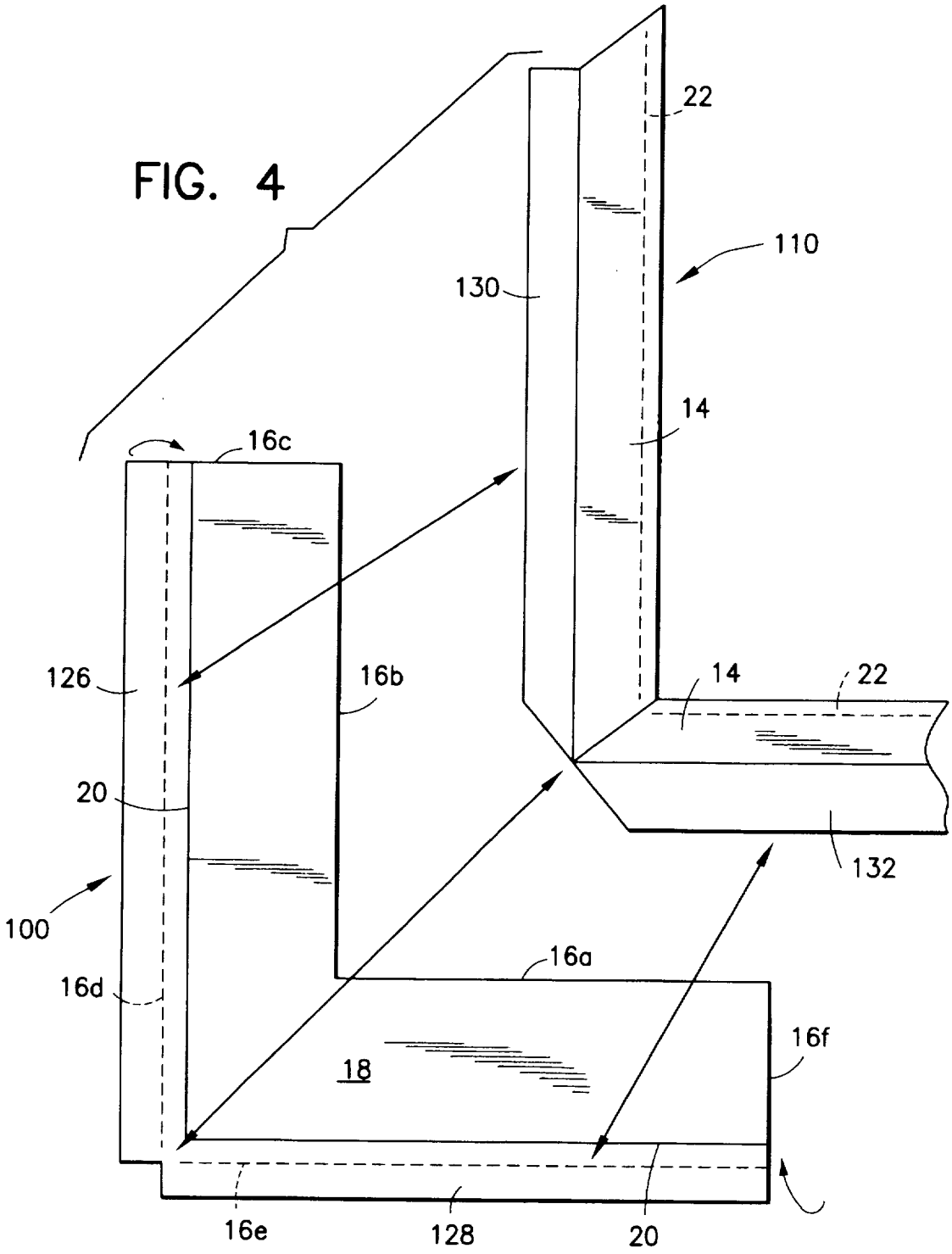
FIG. 4 is a perspective view of a blank used to construct a starter corner in accordance with the invention; and, FIG. 5 is a perspective view of a starter corner constructed and arranged in accordance with the invention in use on a roof.

The starter corner 10 can be formed, for example, using two pieces of suitable edging material having the shapes 100 and 110 shown in FIG. 4. The shape shown as 100 becomes the flat substantially L-shaped piece of edging material 12 and the shape shown as 110 becomes the hem edge 14 when the starter corner 10 is constructed in the manner shown.

Specifically, the shape shown as 110 is placed on the shape shown as 100 so that two securing flanges 130 and 132 are positioned on the underside 18 between the line 20 and each of the outer edges 16*d* and 16*e*, respectively. Two flap members 126 and 128 are then folded upward and over the securing flanges 130 and 132 as indicated by the arrows and press fitted so that the shape 110 is maintained in position on shape 100. Accordingly, the hem edge 14 extends from the underside 18 of the flat L-shaped member 12 along the line 20 to form the starter corner 10.

Figure 5:
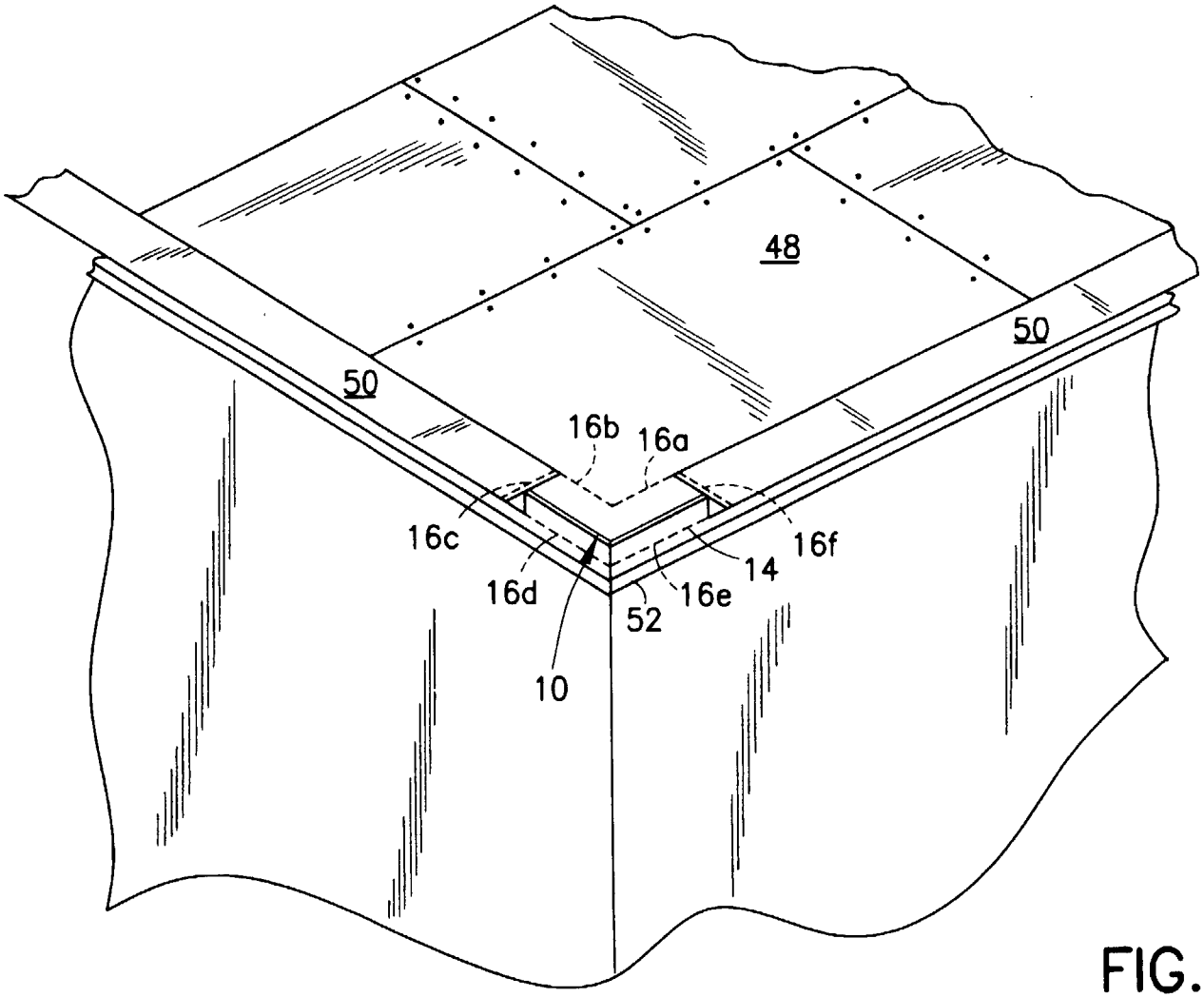

To use the starter corner 10 provided in accordance with the invention, a wooden roof deck is laid and covered with asphalt saturated felt or felt paper to provide an underlayment 48 as shown in FIG. 5. A standard straight drip edge 50 is laid along the eaves until a corner is reached. A starter corner 10 constructed and arranged in accordance with the invention is then laid on the underlayment so that the underside 18 is positioned adjacent the underlayment 48. Each of joining edges 16*c* and 16*f* will then abut a piece of the conventional drip edge 50. Accordingly, the outer edge of the starter corner 16*d* and 16*e* will be positioned over the ground external to the eaves of the roof and the hem edge 14 will abut a fascia 52 of the roof. Shingles are then laid over the underlayment 48, the conventional drip edges 50 and the starter corner 10.

The starter corner provided in accordance with the invention is easy to use, saves time and money and requires minimal manual dexterity to position. Furthermore, a roof constructed using the starter corner provided will be protected from damage due to water and ice formation in the eaves.

It will thus be seen that the objects set forth above, among those made apparent from the preceding description are efficiently attained and, since certain changes may be made in the above constructions without departing from the spirit and scope of the invention, it is intended that all matter contained in the above description or shown in the accompanying drawings be interpreted as illustrative and not in a limiting sense.

It is also to be understood that the following claims are intended to cover all of the the generic and specific features of the invention herein described and all statements of the scope of the invention which, as a matter of language, might be said to fall therebetween.

What is claimed is:

1. A drip-edge starter corner for placing in a corner of a roof against the eaves and over an underlayment comprising:

a substantially flat unseamed L-shaped member having a first leg and a second leg that form an angle therebetween such that the first and second legs define an outer edge that is adapted to be positioned over the ground external to the eaves of the roof and an underside that is adapted to be positioned adjacent to the underlayment of the roof; and, a hem edge formed parallel to the outer edge of the L-shaped member and adjacent to and at an angle with respect to the underside whereby the starter corner can be positioned at a corner of a roof underlayment so that the underside of the L-shaped piece is positioned adjacent the underlayment and the hem edge fits against a fascia of the roof and extends towards the ground to prevent ice formation and backup damage to the finished roof.

2. The starter corner of claim 1 wherein the angle formed between the first leg and the second leg is a right angle.

3. The starter corner of claim 1 wherein the widths of each of the first and the second legs is between about 2 and 4 inches.

4. The starter corner of claim 3 wherein the width of the first leg is equal to the width of the second leg.

5. The starter corner of claim 1 wherein the hem edge is positioned between about ¼ and ¾ inches from the outer edge of the L-shaped member.

6. The starter corner of claim 1 wherein the hem edge has a length of between about ½ and 1½ inches.

7. The starter corner of claim 1 wherein the hem edge includes a flange distal the underside of the L-shaped member.

8. The starter corner of claim 7 wherein the flange extends in the direction of the outer edge of the L-shaped member.

9. The starter corner of claim 1 wherein the starter corner is formed of a metal material.

10. The starter corner of claim 1 wherein the starter corner is formed of a material selected from the group consisting of aluminum, galvanized iron and copper.

11. The starter corner of claim 1 wherein the hem edge is press fitted to the L-shaped member to form the starter corner.

12. A drip-edge starter corner for placing in a corner of a roof against the eaves and over an underlayment comprising:

an unseamed substantially flat L-shaped member formed of a metal material and having a first leg and a second leg that form an angle therebetween such that the first and second legs define an outer edge that is adapted to be positioned over the ground external to the eaves of the roof and an underside that is adapted to be positioned adjacent to the underlayment of the roof; and, a hem edge formed parallel to the outer edge of the L-shaped member and adjacent to and at an angle with respect to the underside whereby the starter corner can be positioned at a corner of a roof underlayment so that the underside of the L-shaped piece is positioned adjacent the underlayment and the hem edge fits against a fascia of the roof and extends towards the ground to prevent ice formation and backup damage to the finished roof.

* * * * *